US008015642B1

(12) United States Patent
Oakley

(10) Patent No.: US 8,015,642 B1
(45) Date of Patent: Sep. 13, 2011

(54) MULTIPURPOSE HANDHELD TOOL AND ASSOCIATED METHOD

(76) Inventor: Dennis C. Oakley, Albany, NY (US)

( * ) Notice: Subject to any disclaimer, the term of this patent is extended or adjusted under 35 U.S.C. 154(b) by 196 days.

(21) Appl. No.: 12/384,045

(22) Filed: Mar. 31, 2009

Related U.S. Application Data

(60) Provisional application No. 61/072,359, filed on Mar. 31, 2008.

(51) Int. Cl.
*B67B 7/44* (2006.01)

(52) U.S. Cl. ..... 7/156; 7/155

(58) Field of Classification Search ..... 7/154–156; 81/3.09, 3.45
See application file for complete search history.

(56) References Cited

U.S. PATENT DOCUMENTS

| | | | | |
|---|---|---|---|---|
| 786,492 | A * | 4/1905 | Garimaldi | 81/3.09 |
| 1,187,842 | A * | 6/1916 | Eilef | 7/168 |
| 1,953,690 | A * | 4/1934 | Samways | 7/167 |
| 4,437,359 | A * | 3/1984 | Dejoux et al. | 81/3.09 |
| 4,854,856 | A | 8/1989 | Steiger | |
| 5,946,753 | A | 9/1999 | Roberts | |
| 6,032,553 | A * | 3/2000 | Brucart Puig et al. | 81/3.09 |
| 6,101,900 | A * | 8/2000 | Traspuesto Miguel | 81/3.48 |
| 6,116,116 | A * | 9/2000 | Brucart Puig et al. | 81/3.37 |
| 6,142,769 | A | 11/2000 | Walker | |
| 6,176,154 | B1 * | 1/2001 | Brucart Puig et al. | 81/3.47 |
| 6,273,582 | B1 * | 8/2001 | Taggart et al. | 362/119 |
| 6,557,440 | B1 * | 5/2003 | Presa Eguren | 81/3.47 |
| 6,622,330 | B2 * | 9/2003 | Puig | 7/155 |
| D503,598 | S | 4/2005 | So | |
| 7,036,952 | B2 * | 5/2006 | Zirk et al. | 362/119 |
| 7,272,992 | B2 * | 9/2007 | Farfalli et al. | 81/3.09 |
| 7,614,322 | B1 * | 11/2009 | Corredor-Londono | 81/3.09 |
| 2002/0157188 | A1 * | 10/2002 | Sannajust | 7/156 |

* cited by examiner

*Primary Examiner* — David B Thomas

(57) ABSTRACT

A multipurpose handheld tool includes a casing having a cavity and two flanges at the end of the casing, and a variety of tools pivotally coupled to the casing. Each of the tools is independently articulated along a unique arcuate path defined between retracted and deployed positions. The apparatus include a plurality of tools such as a wine knife with a lemon skin peeler; a serrated cutting utensil; a can opener; and a bottle cap popper preferably having a concave curvilinear edge and a clock positioned at the proximal end of the casing. In particular, one of the tools is a bifurcated wine key lever having two members held together by a resilient metal band. A writing utensil and a retractable flashlight are also provided.

16 Claims, 6 Drawing Sheets

MULTIPURPOSE HANDHELD TOOL AND ASSOCIATED METHOD

CROSS REFERENCE TO RELATED APPLICATIONS

This application claims the benefit of U.S. Provisional Application No. 61/072,359, filed Mar. 31, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to handheld tools and, more particularly, to a multipurpose handheld tool for providing a variety of implements, in one unit, that are typically used by professional bartenders.

2. Prior Art

Tending bar can be a fun and rewarding career. Whether pouring icy cold beers at the local tavern, blending coladas and daiquiris at a beach front resort, or serving cosmopolitans in a Manhattan nightclub, bartending can be an exciting way to meet new, interesting people and earn great money in the process. Most bartenders earn an hourly salary, plus receive generous tips from their customers. With today's standard tip being 20% of the customer's total bill, tending bar can indeed be a profitable career choice. In fact, many large bars and restaurants offer their bar staff full benefits and comprehensive insurance plans. Bartenders who work for major hotel chains and airlines also receive perks such as free lodging or reduced price airfare around the world. Additionally, many prefer working the evening hours that most bartending jobs afford and the ability to choose the bar or restaurant surroundings that best suit their individual personality.

As with many professionals, bartenders depend on a variety of implements when completing their work. Whether a wine knife utilized to remove the stiff foil seal from the top of a wine bottle, a flashlight used to illuminate a customer's bill, or a bottle opener designed to effortlessly flip the cap off a bottle of icy cold beer—there are countless tools utilized when bartending which must be readily available at all times.

Further, items such as a cigar cutter for use in nipping the end off a customer's cigar, or a pen to be lent to a couple who wishes to exchange phone numbers—bartenders must keep a wide array of implements on hand not only to execute bartending tasks, but also to keep customers happy in the process. Unfortunately, keeping these many tools and instruments neat and organized when on the job can be problematic. Stuffed into an apron pocket, various size openers, flashlights, pens and similar instruments can be extremely bulky and heavy. Placed in a storage drawer, items stored haphazardly can be difficult to locate when needed.

Accordingly, the present invention is disclosed in order to overcome the above noted shortcomings. The multipurpose handheld tool is convenient and easy to use, lightweight yet durable in design, and designed for providing a variety of implements, in one unit, that are typically used by professional bartenders. The device is simple to use, inexpensive, and designed for many years of repeated use.

BRIEF SUMMARY OF THE INVENTION

In view of the foregoing background, it is therefore an object of the present invention to provide an apparatus for a multifunctional hand-operable tool for use in restaurant environments. These and other objects, features, and advantages of the invention are provided by a multifunctional hand-operable tool and associated method.

The multifunctional hand-operable tool may preferably include a casing having a cavity and a plurality of tools pivotally coupled to such a casing. Each of the tools may preferably be independently articulated along a unique arcuate path defined between retracted and deployed positions. One of such tools preferably has a bifurcated wine key lever having a first member and a second member resiliently biased along a fulcrum axis traversing along a longitudinal length of the wine key lever.

Such a wine key lever may preferably be configured in such a manner that the first and second members are aligned along a rectilinear path when pivoted to the retracted position. In this way, the wine key lever may remain exposed exterior of the casing while positioned at the retracted and deployed positions respectively. The second member may further be pivotally coupled directly to the casing with the first member remaining spaced from the casing while the wine key lever is biased to the deployed position. The wine key lever may further include first and second slots formed adjacent to conjoining edges of the first and second members respectively.

A band may preferably be positioned through the first and second slots and wrapped about the conjoining edges of the first and second members such that the band is deformably resilient, during operating conditions. The band is preferably configured in such a manner that a resistive force is exerted against the first member when the wine key lever is pivotally offset along the fulcrum axes. Such a fulcrum axis may preferably be defined along the conjoining edges of the first and second members respectively. The combination of such first and second members of the wine key lever provides an unpredictable and unexpected advantage of having a first and second leverage point for extraction of the cork from a wine bottle.

In one embodiment, the casing may include anterior and posterior plates equidistantly spaced apart along a major longitudinal length of the casing such that the cavity maintains a uniform thickness along the entire respective longitudinal lengths of the first and second members. In addition, the apparatus may further include first and second flange portions directly coupled to proximal and distal ends of the casing respectively such that each of the flange portions axially extends away from the casing and face axially opposed directions respectively.

The apparatus may further include a plurality of tools selected from a group of tools including: a wine knife preferably provided with a lemon skin peeler situated at the first flange portion; a serrated cutting utensil preferably situated adjacent to the proximal end and juxtaposed adjacent to the first flange portion; a corkscrew preferably situated adjacent to the wine key lever; and a can opener situated at the distal end of the casing and further juxtaposed adjacent to the second flange portion.

In one embodiment, the apparatus may include any combination of such tools as may be optimized for a user. In addition, the apparatus may further include a bottle cap popper preferably having a concave curvilinear edge. A clock may also be positioned at the proximal end of the casing.

In another embodiment, the apparatus may further include a rectilinear slot formed in the anterior face of the casing. An ink pen may be provided, which is removably positioned within the slot. The ink pen may preferably be countersunk within the slot while housed in a stored position. In this manner, the ink pen may be held securely in place within the slot and easily extracted by user when the need arises.

The apparatus may further include a retractable flashlight attached to the casing. Such a retractable flashlight preferably includes a body provided with a light-emitting source located at a distal end of the casing. The flashlight may preferably include a switch and a power source communicatively coupled thereto. In use, the body is automatically displaced to a deployed position when the switch is linearly biased along an axial path defined parallel to a longitudinal length of the casing. In this manner, the switch may be toggled to an open position while the body is at the deployed position and may further be toggled to a closed position while the body is linearly biased to a retracted position. This arrangement allows the user to easily turn the flashlight to an "on" or "off" position such as for example, with his/her thumb in a speedy and effortless manner.

The present invention may further include a method of utilizing a multifunctional hand-operable tool for use in restaurant environments. Such a method may include the chronological steps of: providing a casing having a cavity; providing a plurality of tools to the casing such that one of the tools may include a bifurcated wine key lever preferably having a first and a second member; and pivotally coupling the tools to the casing such that the wine key lever is pivotally coupled to the casing by pivotally coupling the second member directly to the casing.

The method may further include the chronological steps of: aligning the first and second members along a rectilinear path when pivoted to the retracted position; resiliently biasing the first and second members along a fulcrum axis by traversing a longitudinal length of the wine key lever; maintaining the first member spaced from the casing while the wine key lever is biased to the deployed position; and maintaining the wine key lever exposed exterior of the casing while positioned at the retracted and deployed positions respectively. The method may further include the step of: independently articulating each of the tools along a unique arcuate path defined between retracted and deployed positions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
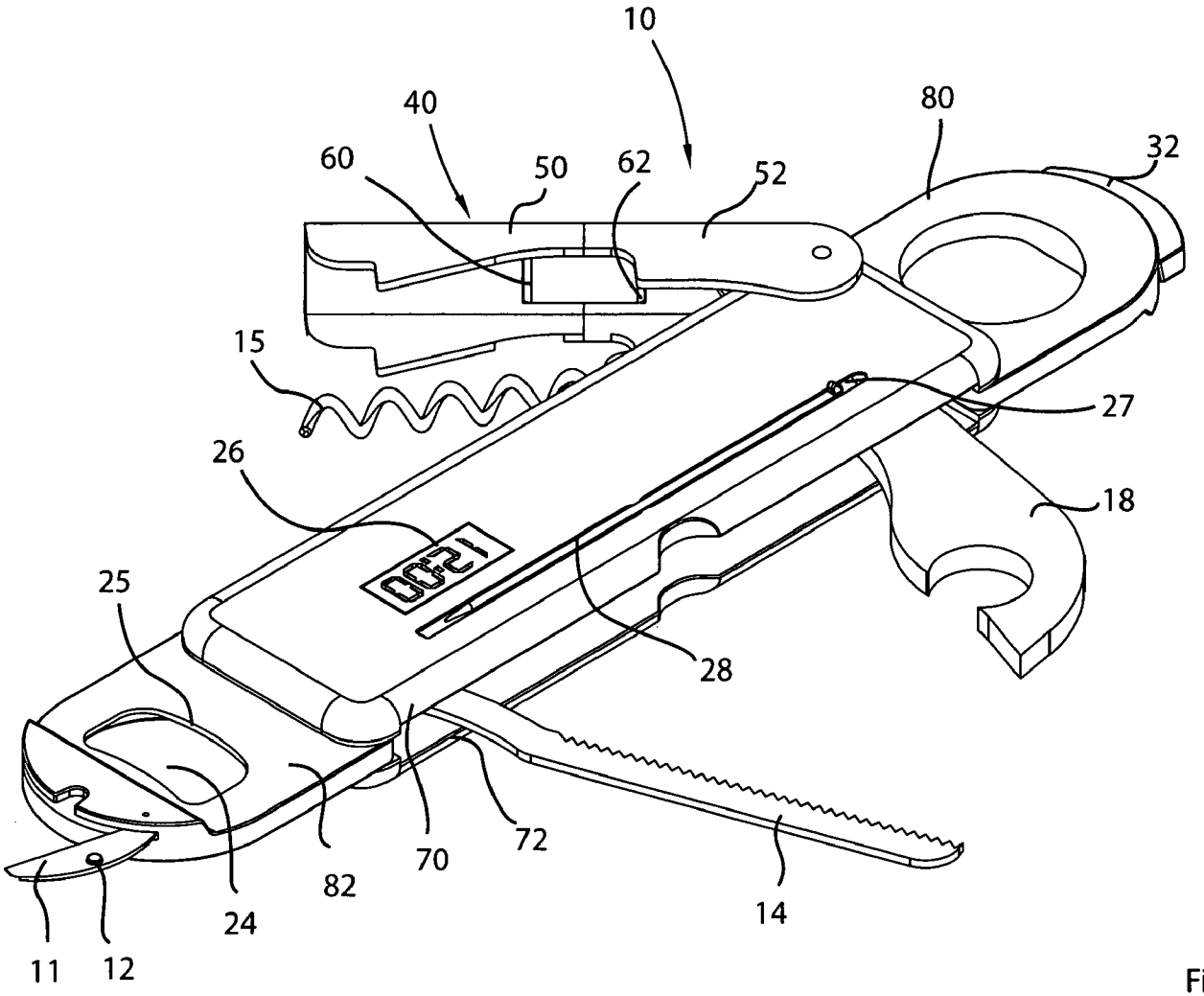
FIG. 1 is a perspective view of a multipurpose tool showing some of the tools at deployed positions, in accordance with the present invention.
Figure 2:
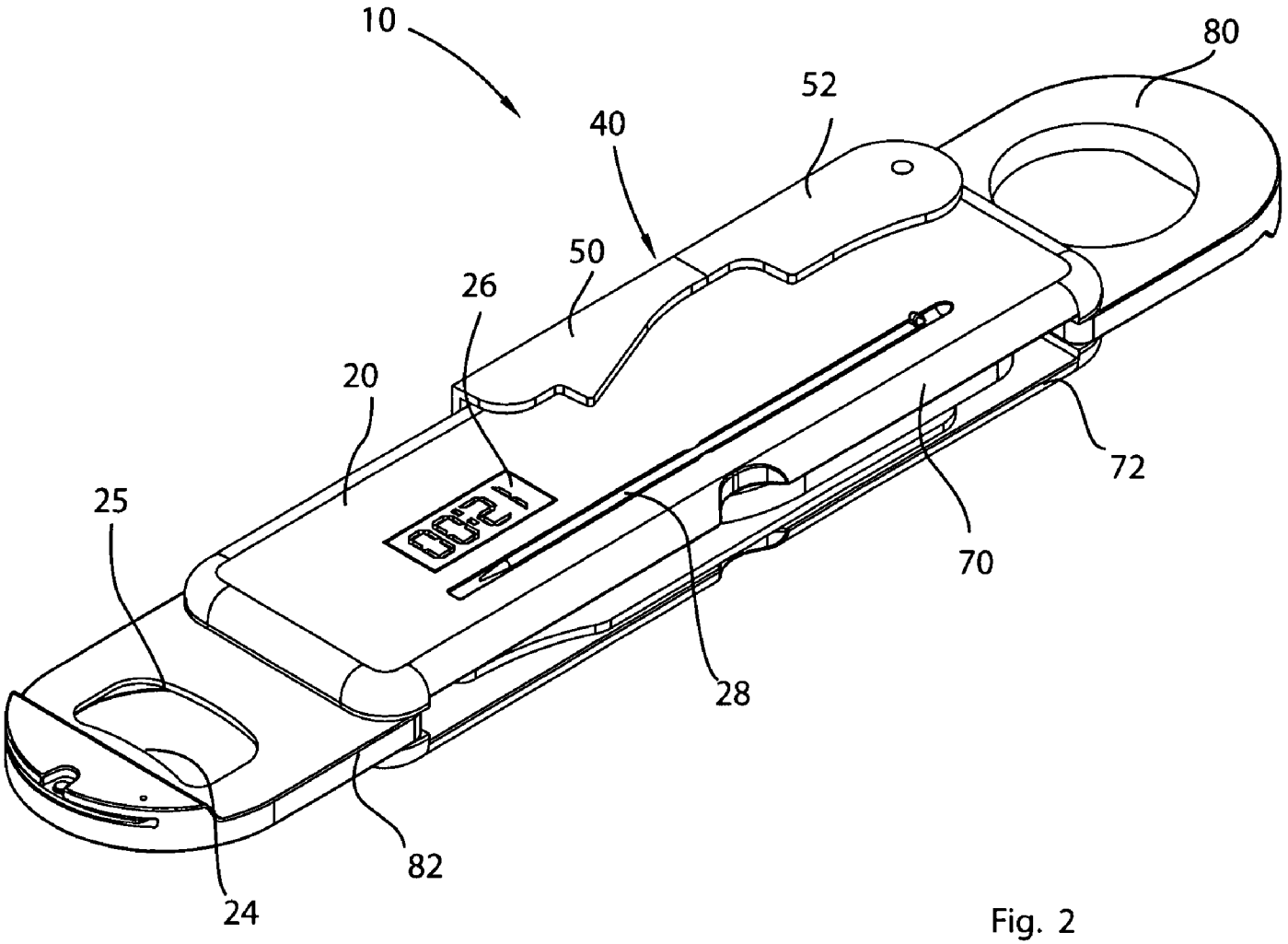
FIG. 2 is a perspective view of the multipurpose tool showing the tools in retracted positions.
Figure 3:
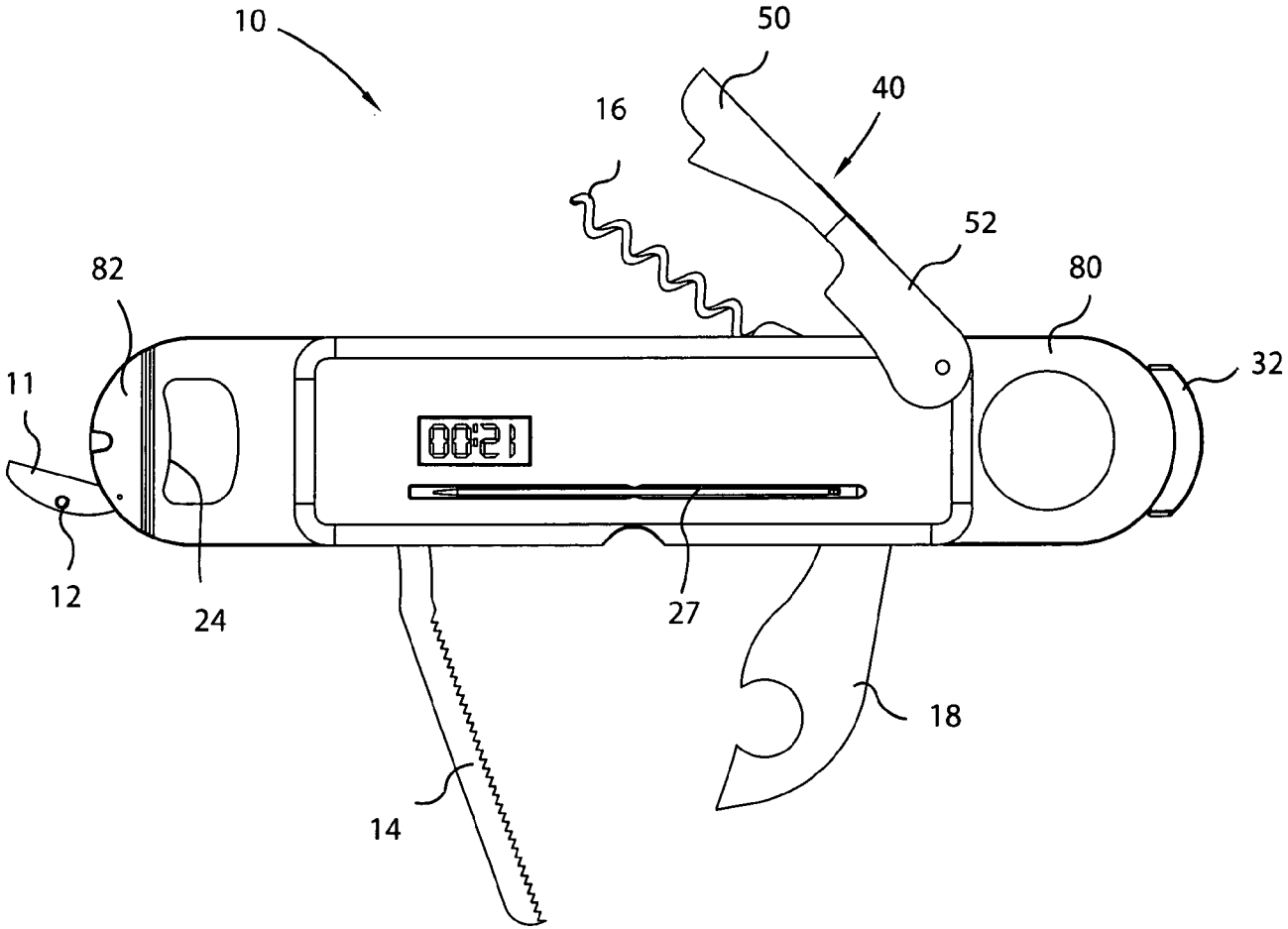
FIG. 3 is a top plan view of the multipurpose tool shown in FIG. 1.
Figure 4:
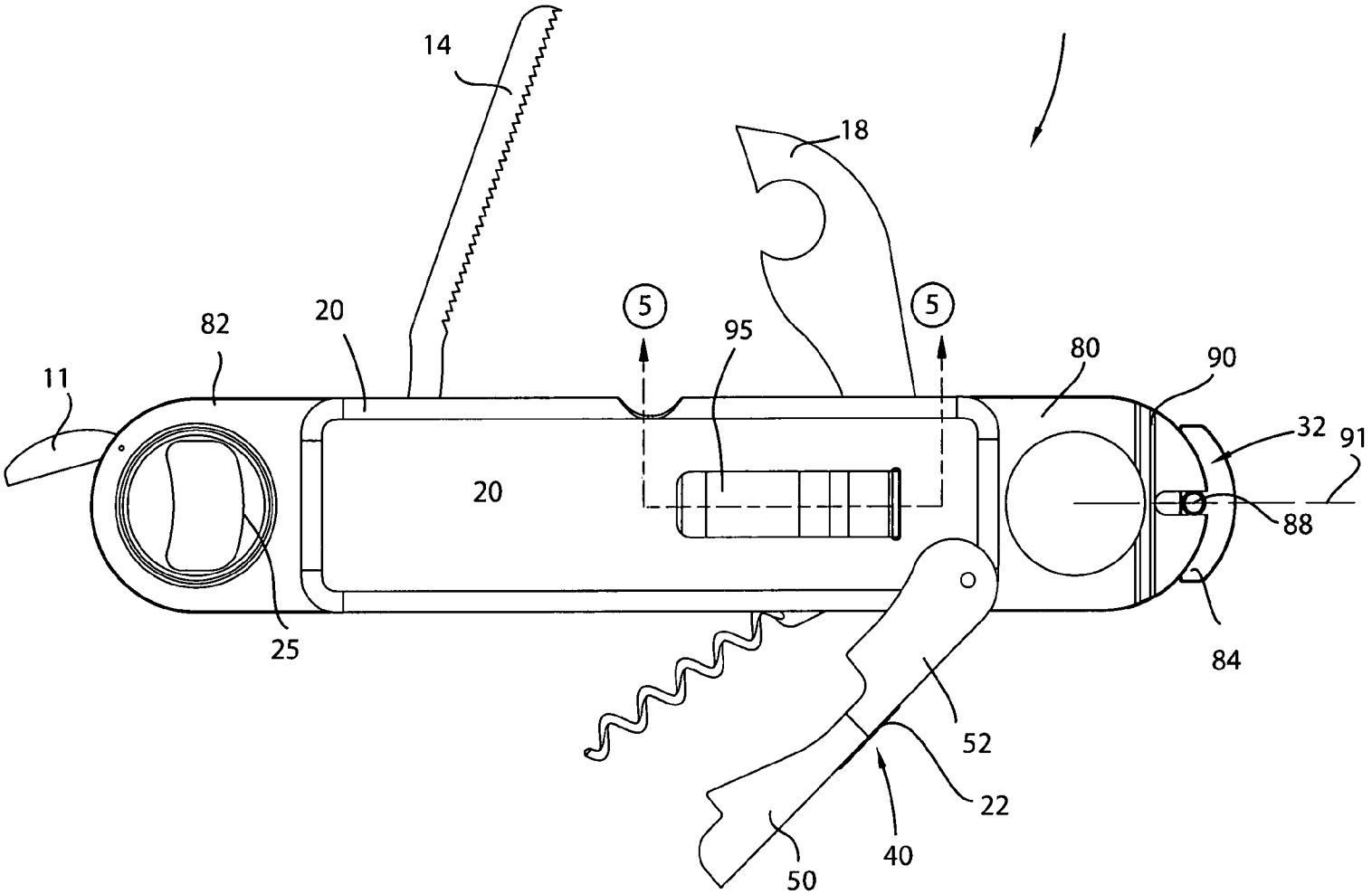
FIG. 4 is a bottom plan view of the multipurpose tool shown in FIG. 1.
Figure 5:
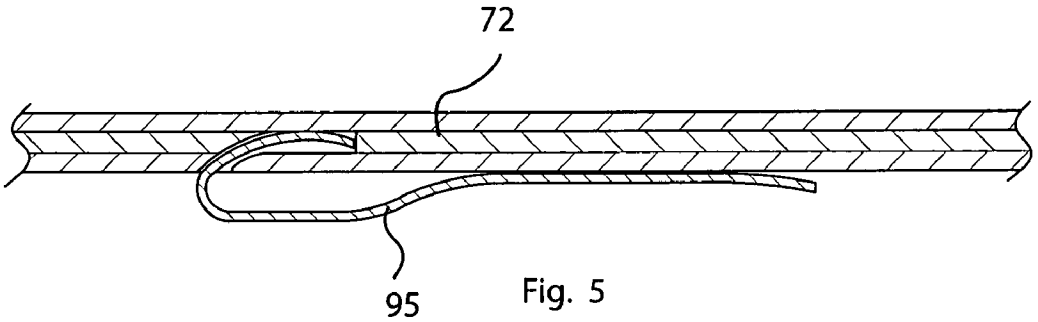
FIG. 5 is a cross-sectional view of a belt clip along line 5-5 in FIG. 4.
Figure 6:
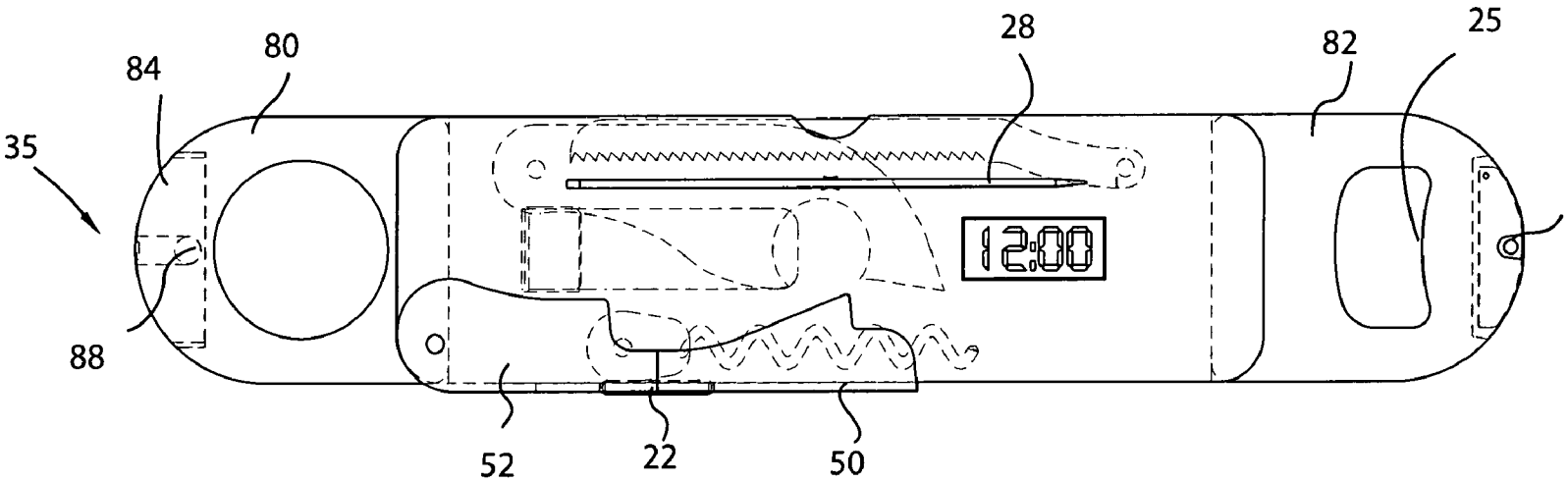
FIG. 6 is a top plan view of the multipurpose tool shown in FIG. 1.
Figure 7:
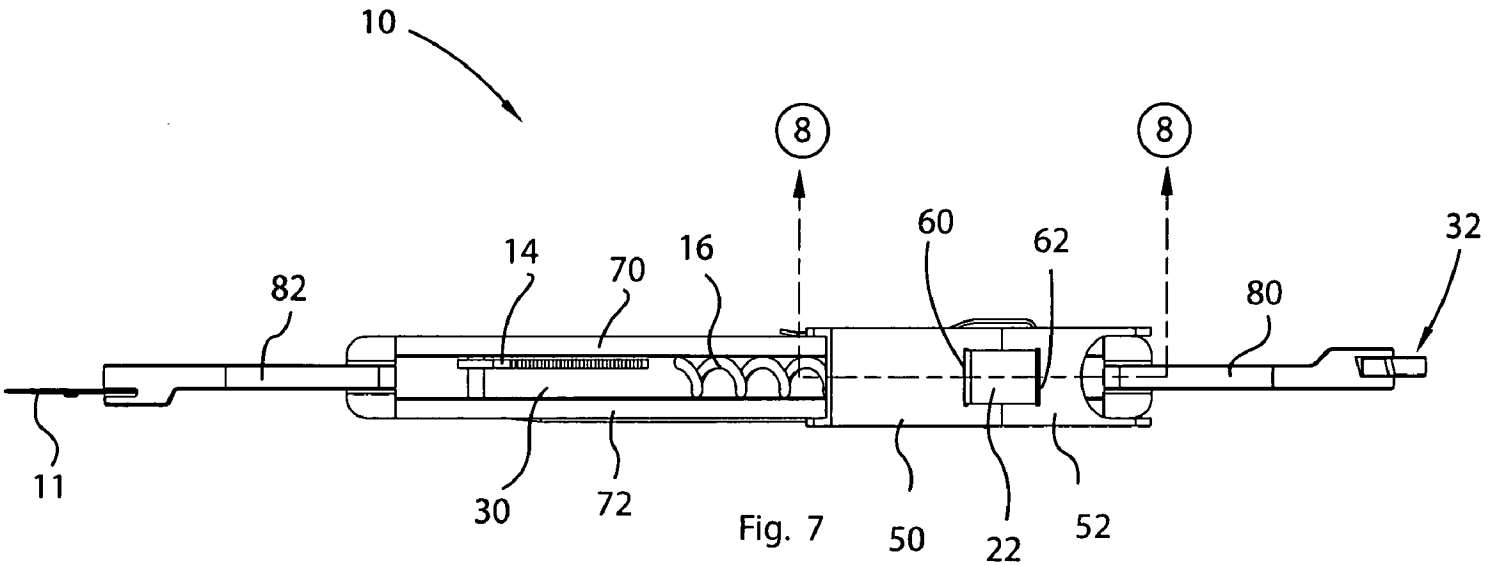
FIG. 7 is a side elevational view of the multipurpose tool shown in FIG. 1.
Figure 8:
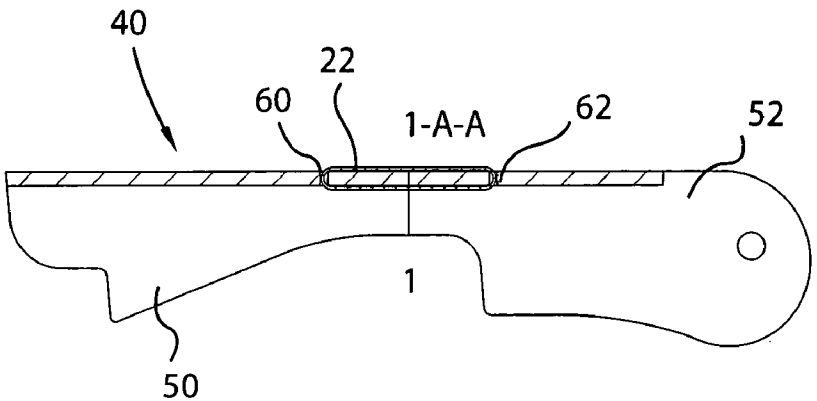
FIG. 8 is an enlarged cross-sectional view of the wine key lever along line 8-8 in FIG. 7.

A multifunctional hand-operable tool is referred to generally in FIGS. 1-8 by the reference numeral 10 and is intended to provide a multifunctional hand-operable tool for use in a restaurant environment. It should be understood that the invention is not limited to use in restaurant environments only but may also be useful in a variety of other environments such as at home, parties and during outdoor cook outs where the multifunctional capabilities of this invention can be put to good use.

The multifunctional hand-operable tool may preferably include a casing 20 having a cavity 30 (FIG. 7) and a plurality of tools (identified hereinbelow) pivotally coupled to such a casing 20. Each of the tools may be independently articulated along a unique arcuate path defined between retracted and deployed positions. It is noted that each arcuate path is defined about a pivot point at which each tool is pivotally connected to the casing, for example.

One of such tools may include a bifurcated wine key lever 40 having a first member 50 and a second member 52 resiliently biased along a fulcrum axis A-A (FIG. 8), traversing along a longitudinal length of the wine key lever 40. Such a wine key lever 40 may be configured in such a manner that the first member 50 and the second member 52 are aligned along a rectilinear path when pivoted to the retracted position, as perhaps best shown in FIGS. 2 and 6-8. In this manner, the wine key lever 40 may remain exposed exterior of the casing 20 while positioned at the retracted and deployed positions respectively, as perhaps best shown in FIGS. 1-7.

The second member 52 may further be pivotally coupled directly to the casing 20, with the first member 50 remaining spaced from the casing 20 while the wine key lever 40 is biased to the deployed position. The wine key lever 40 may further include a first slot 60 and a second slot 62 formed adjacent to conjoining edges of the first member 50 and second member 52 respectively.

A band 22 may be positioned through the first and second slots 60, 62 and wrapped about the conjoining edges of the first and second members 50, 52 such that the band 22 is deformably resilient when the wine key lever 40 is pivoted about axis A-A. The band 22 is preferably configured in such a manner that a resistive force is exerted against the first member 50 when the wine key lever 40 is pivotally offset along the fulcrum axis. As perhaps best shown in FIG. 8, such a fulcrum axis A-A may preferably be defined along the conjoining edges of the first member 50 and second member 52, respectively. The combination of such first and second members 50, 52 of the wine key lever 40 provides an added advantage of having first and second leverage points for extracting a cork from a wine bottle.

In one embodiment, the casing 20 may include anterior 70 and posterior plates 72 equidistantly spaced apart along a major longitudinal length of the casing 20 such that the cavity 30 (FIG. 7) preferably maintains a uniform thickness along the entire respective longitudinal lengths of the anterior and posterior plates 70, 72. In addition, the apparatus 10 may further include a first flange portion 80 and a second flange portion 82 directly coupled to proximal and distal ends of the casing 20, respectively, such that each of the flange portions 80, 82 axially extends away from the casing 20 and faces axially opposed directions respectively.

In one embodiment, the tools may be selected from a group of tools including: a wine knife 11 provided with a lemon skin peeler 12 situated at the first flange 82 portion; a serrated cutting utensil 14 preferably situated adjacent to the proximal end and juxtaposed adjacent to the first flange 82 portion; a corkscrew 16 preferably situated adjacent to the wine key lever 40; and a can opener 18 situated at the distal end of the casing 20 and further juxtaposed adjacent to the second flange 80 portion. A belt clip 95 is also provided as being mated to the posterior face 72 of the casing 20.

The lemon skin peeler 12 produces a lemon-twist garnish by concentrically dragging the lemon twist peeler/hole along a continuous and revolving surface of the lemon. The belt clip 95 allows the user to easily and quickly attach the casing 20 to a belt for convenient access. Of course, casing 20 may also be stored in a shirt or pants pocket, as needed.

Of course, any combination of such tools may be employed as desired by the user. In addition, the apparatus 10 may further include a bottle cap popper 24 preferably having a concave curvilinear edge 25. The curvilinear edge 25 is suitably sized and shaped for contiguously abutting an arcuate edge of a conventional bottle cap. Such contiguous abutment maximizes the surface area contact between edge 25 and the bottle cap and thereby ensures adequate contact points are maintained between edge 25 and the bottle cap. In this manner, more leverage is obtained when a user pops open a bottle of beer, for example. In one embodiment, a clock 26 may be positioned at the proximal end of the casing 20. In one embodiment, the posterior face of casing 20 include a reflective or polished "mirror" surface for assisting the user to quickly groom his/her hair in a stealthy manner.

In one embodiment, the apparatus 10 may further include a rectilinear slot 27 formed in an anterior face of the casing 20. A writing utensil, such an ink pen 28, may be removably positioned within the slot 27. The ink pen 28 may preferably be countersunk within the slot 27 while housed in a stored position. In this manner, the ink pen 28 may be securely held in place within the slot 27 while being easily extracted by user when the need arises.

The apparatus 10 may further include a retractable flashlight 32 attached to the casing 20. Such a retractable flashlight 32 preferably includes a body 84 provided with a light-emitting source located at a distal end of the casing 20. The flashlight 32 may preferably include a switch 88 and a power source 90 communicatively coupled thereto such that the body 84 is automatically displaced to a deployed position when the switch 88 is linearly biased along an axial path (91) defined parallel to a longitudinal length of the casing 20. In this manner, the switch 88 may be toggled to an open position when the body 84 is at the deployed position and may further be toggled to a closed position so that the body 84 is linearly biased to a retracted position. This arrangement allows the user to easily turn the flashlight 32 to an "on" or "off" position such as for example, with his/her thumb in a speedy and effortless manner.

The present invention may further include a method of utilizing a multifunctional hand-operable tool for use in restaurant environments. Such a method may include the chronological steps of: providing a casing 20 having a cavity 30; providing a plurality of tools to the casing 20. One of such tools may include a bifurcated wine key lever 40 preferably having a first member 50 and a second member 52.

The method may further include the chronological steps of: pivotally coupling the tools to the casing 20. In particular, such a step may include pivotally coupling the wine key lever 40 to the casing 20 by pivotally coupling the second member directly to the casing 20.

The method may further include the chronological steps of: aligning the first 50 member and a second member 52 of the wine key lever 40 along a rectilinear path when pivoted to the retracted position; resiliently biasing the first member 50 and a second member 52 along a fulcrum axis A-A, by traversing a longitudinal length of the wine key lever; maintaining the first member spaced from the casing 20, while the wine key lever 40 is biased to the deployed position; and maintaining the wine key lever 40 exposed exterior of the casing 20 while positioned at the retracted and deployed positions, respectively. The method may further include the step of independently articulating each of the tools along a unique arcuate path defined between retracted and deployed positions.

The present invention, as claimed provides the unexpected and unpredicted benefit of organizing a multiplicity of bartender tools into a compact and sleek unit which provides an unpredictable and unexpected efficient, safe and speedy utility in a fast paced and dark environment such as a nightclub or restaurant. The combination of such claimed elements is not rendered obvious by one skilled in the art because the multifunctional tool would provide bartenders all the implements needed on the job thereby eliminating the need to stuff one's pockets with bottle openers, corkscrews, pens and flashlights, for example. The device will ensure all of these items are easily accessed with one tool, whether opening a bottle of wine, popping the cap off an icy cold bottle of beer, or signing one's name on a bar tab, the multipurpose handheld tool would ensure that one would never have to dig through pockets or search through crowded storage drawers in order to complete a designated task such increasing the productivity of users.

Compact in design and lightweight, the device could be easily secured to any keychain, tucked in a pocket or placed right on the bar, taking little storage space. Boasting a plethora of quality tools, the device is a versatile product which would serve a wide variety of useful applications. Enabling the bartender to focus their attention on the customer, the multipurpose handheld tool will serve to improve bartender/customer relations, resulting in happier clientele and increased tips. Ideal for use by bartenders, professional servers such as waitresses, busers and hosts, will appreciate the many benefits this useful product. Durably constructed, this cleverly designed tool should withstand years of repeated use.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A multifunctional hand-operable tool for use in restaurant environments, said multifunctional hand-operable tool comprising:

a casing having a cavity defined therein; and a plurality of tools pivotally coupled to said casing, each of said tools being independently articulated along a unique arcuate path defined between retracted and deployed positions;

wherein one of said tools includes a bifurcated wine key lever having first and second members resiliently biased along a fulcrum axis traversing a longitudinal length of said wine key lever, said wine key lever being configured in such a manner that said first and second members are aligned along a rectilinear path when pivoted to said retracted position;

wherein said wine key lever remains exposed exterior of said casing while positioned at said retracted and deployed positions respectively;

wherein said casing comprises anterior and posterior plates equidistantly spaced apart along a major longitudinal length of said casing such that said cavity maintains a uniform thickness along entire respective longitudinal lengths of said anterior and posterior plates.

2. The multifunctional hand-operable tool of claim 1, wherein said wine key lever further comprises:

first and second slots formed adjacent to conjoining edges of said first and second members respectively; and a band positioned through said first and second slots and wrapped about said conjoining edges of said first and second members respectively;

wherein said band is deformably resilient and configured in such a manner that a resistive force is exerted against said first member when said wine key lever is pivotally offset along said fulcrum axes;

wherein said fulcrum axis is defined along said conjoining edges of said first and second members respectively.

3. The multifunctional hand-operable tool of claim 1, further comprising: first and second flange portions directly coupled to proximal and distal ends of said casing respectively, each of said flange portions axially extending away from said casing and facing axially opposed directions respectively.

4. The multifunctional hand-operable tool of claim 3, wherein said tools further comprise: a plurality of tools selected from a group of tools comprising a wine knife provided with a lemon skin peeler situated at said first flange portion;

a serrated cutting utensil situated adjacent to said proximal end and juxtaposed adjacent to said first flange portion;

a corkscrew situated adjacent to said wine key lever;

a can opener situated at said distal end of said casing and being juxtaposed adjacent to said second flange portion; and any combination thereof.

5. The multifunctional hand-operable tool of claim 1, further comprising: a bottle cap popper having a concave curvilinear edge.

6. The multifunctional hand-operable tool of claim 1, further comprising: a clock positioned at said proximal end of said casing.

7. The multifunctional hand-operable tool of claim 1, further comprising:

a rectilinear slot formed in said anterior face of said casing; and an ink pen removably positioned within said slot, said ink pen being countersunk within said slot while housed at a stored position.

8. The multifunctional hand-operable tool of claim 1, further comprising: a retractable flashlight attached to said casing, said retractable flashlight comprising a body provided with a light-emitting source located at a distal end thereof; and a switch and a power source communicatively coupled thereto;

wherein said body is automatically displaced to a deployed position when said switch is linearly biased along an axial path defined parallel to a longitudinal length of said casing;

wherein said switch is toggled to an open position while said body is at said deployed position;

wherein said switch is toggled to a closed position while said body is linearly biased to a retracted position.

9. A multifunctional hand-operable tool for use in restaurant environments, said multifunctional hand-operable tool comprising:

a casing having a cavity defined therein; and a plurality of tools pivotally coupled to said casing, each of said tools being independently articulated along a unique arcuate path defined between retracted and deployed positions;

wherein one of said tools includes a bifurcated wine key lever having first and second members resiliently biased along a fulcrum axis traversing a longitudinal length of said wine key lever, said wine key lever being configured in such a manner that said first and second members are aligned along a rectilinear path when pivoted to said retracted position;

wherein said wine key lever remains exposed exterior of said casing while positioned at said retracted and deployed positions respectively;

wherein said second member is pivotally coupled directly to said casing and said first member remains spaced from said casing while said wine key lever is biased to said deployed position;

wherein said casing comprises anterior and posterior plates equidistantly spaced apart along a major longitudinal length of said casing such that said cavity maintains a uniform thickness along entire respective longitudinal lengths of said anterior and posterior plates.

10. The multifunctional hand-operable tool of claim 9, wherein said wine key lever further comprises:

first and second slots formed adjacent to conjoining edges of said first and second members respectively; and a band positioned through said first and second slots and wrapped about said conjoining edges of said first and second members respectively;

wherein said band is deformably resilient and configured in such a manner that a resistive force is exerted against said first member when said wine key lever is pivotally offset along said fulcrum axes;

wherein said fulcrum axis is defined along said conjoining edges of said first and second members respectively.

11. The multifunctional hand-operable tool of claim 9, further comprising: first and second flange portions directly coupled to proximal and distal ends of said casing respectively, each of said flange portions axially extending away from said casing and facing axially opposed directions respectively.

12. The multifunctional hand-operable tool of claim 11, wherein said tools further comprise: a plurality of tools selected from a group of tools comprising a wine knife provided with a lemon skin peeler situated at said first flange portion;

a serrated cutting utensil situated adjacent to said proximal end and juxtaposed adjacent to said first flange portion;

a corkscrew situated adjacent to said wine key lever;

a can opener situated at said distal end of said casing and being juxtaposed adjacent to said second flange portion; and any combination thereof.

13. The multifunctional hand-operable tool of claim 9, further comprising: a bottle cap popper having a concave curvilinear edge.

14. The multifunctional hand-operable tool of claim 9, further comprising: a clock positioned at said proximal end of said casing.

15. The multifunctional hand-operable tool of claim 9, further comprising:

a rectilinear slot formed in said anterior face of said casing; and an ink pen removably positioned within said slot, said ink pen being countersunk within said slot while housed at a stored position.

16. The multifunctional hand-operable tool of claim 9, further comprising: a retractable flashlight attached to said casing, said retractable flashlight comprising a body provided with a light-emitting source located at a distal end thereof; and a switch and a power source communicatively coupled thereto;

wherein said body is automatically displaced to a deployed position when said switch is linearly biased along an axial path defined parallel to a longitudinal length of said casing;

wherein said switch is toggled to an open position while said body is at said deployed position;

wherein said switch is toggled to a closed position while said body is linearly biased to a retracted position.

* * * * *